US006718671B1

(12) United States Patent
Cluff

(10) Patent No.: US 6,718,671 B1
(45) Date of Patent: Apr. 13, 2004

(54) GOLF COURSE SIGN

(76) Inventor: Shane Cluff, 215 Oakland Avenue, Winnipeg, Manitoba (CA), R2G 0A7

( * ) Notice: Subject to any disclaimer, the term of this patent is extended or adjusted under 35 U.S.C. 154(b) by 0 days.

(21) Appl. No.: 09/576,319

(22) Filed: May 26, 1998

(51) Int. Cl.[7] ..... G09F 7/02
(52) U.S. Cl. ..... 40/611.03; 40/607.05
(58) Field of Search ..... 40/606, 607, 611, 40/574, 768, 790, 779

(56) References Cited

U.S. PATENT DOCUMENTS

| | | | | | |
|---|---|---|---|---|---|
| 1,487,500 | A | * | 3/1924 | Williams | 40/606 |
| 3,132,431 | A | * | 5/1964 | Petrie | 40/611 |
| 3,289,337 | A | * | 12/1966 | Golkowski | 40/606 |
| 4,005,537 | A | * | 2/1977 | von Camber et al. | 40/610 |
| 4,092,792 | A | * | 6/1978 | Vorhees | 40/607 |
| 4,241,530 | A | * | 12/1980 | Hartvig | 40/607 |
| 4,916,840 | A | * | 4/1990 | Getz | 40/605 |
| 5,283,967 | A | * | 2/1994 | Abrams | 40/779 |
| 5,442,871 | A | * | 8/1995 | Sarkisian et al. | 40/606 |

* cited by examiner

*Primary Examiner*—Gary Hoge
(74) *Attorney, Agent, or Firm*—Adrian D. Battison; Michael R. Williams

(57) ABSTRACT

A golf sign for displaying golf hole information on a golf course comprises a flexible, replaceable, printed display sheet having thereon an accurate graphic illustration of a golf hole, information concerning distance from the tee of the golf hole to the flat of the golf hole and advertising information relating to a sponsor of the sign. The printed sheet is mounted in a rectangular receptacle mounted on two legs with an open rear face and an open front face and a pivotal rectangular door mounted inside the receptacle for pivotal movement on hinges along one side of the door. The door has a vertical front plate which receives the sheet and holds it behind a transparent cover panel which is pressed against surrounding flanges at the front of the receptacle by a plurality of elongate spacer members arranged around the front surface of the door.

6 Claims, 3 Drawing Sheets

GOLF COURSE SIGN

This invention relates to a sign for displaying golf hole information on a golf course.

BACKGROUND OF THE INVENTION

It is well known at each Tee on a golf course to provide to the golfer a sign providing information concerning the layout of the hole. Often this sign includes information concerning distances from the Tee to the hole, the par and in some cases yet further information, such as landscaping. It is also known to provide advertising on the sign which is sold to a sponsor to offset the cost of installing the sign and in some cases to provide some profit.

Generally the signs are manufactured from wood by generating a relief pattern in the wood and by coloring the relief pattern. Other materials which are used include stone or granite signs which again are generated in a relief pattern. Signs of this type are extremely expensive and thus are effectively permanent or at least very long lasting. The sale of advertising on the signs, therefore, is not widespread since the cost of manufacture is relatively high and since the sign is difficult to replace on a short term basis should the advertiser only wish to have his advertisement on display for a short term or should he wish to cancel the advertisement. The economics of the sign manufacture, the longevity of the sign and the amount of money available from advertisers has therefore not been compatible to generate significant incomes from advertising in this way.

One further problem with the permanent type of sign is that these are impossible to change should the geography of the golf course be changed for redesigns or to accommodate some landscaping problems. Thus even if one hole should change, this often can change the geography of other holes and therefore each sign for those changed holes becomes inaccurate. Due to the reluctance of course officials to change all such permanent signs, the signs themselves are relatively crude and inaccurate so that minor changes can be accommodated. In addition where changes to the hole are sufficient to make the information inaccurate, this inaccurate information usually remains in place thus misleading golfers unfamiliar with the course.

Up till now only the relatively permanent materials of the hardwood and stone type signs have been considered suitable since paper materials are prone to degradation and cannot provide the attractive appearance necessary for the relatively high scale situation of a golf course.

An alternative arrangement by the present inventor is shown in Canadian Application No. 2,095,752 filed May 7, 1993 and published Nov. 8, 1994. This shows a flexible printed paper sign which is mounted on a support so that the sign can be quickly and easily be replaced allowing the printing of additional information including advertising material. In this way, the sign can be used for sale of advertising to sponsors providing an additional source of revenue. However the mounting for the sign is crude and ineffective to allow the sign to be maintained on good condition so that the arrangement has met with some resistance and has not met with commercial success in that form.

SUMMARY OF THE INVENTION

It is one object of the present invention, therefore, to provide an improved sign for displaying golf hole information on a golf course.

According to the invention there is provided a golf sign for displaying golf hole information on a golf course comprising:

a flexible, replaceable, printed display sheet having thereon an accurate graphic illustration of a golf hole, information concerning distance from the tee of the golf hole to the flat of the golf hole and advertising information relating to a sponsor of the sign;

and a support mount for the display sheet including:

depending legs for mounting the support mount extending vertically from the ground;

a rectangular receptacle mounted on the legs and defining a top horizontal wall, a bottom horizontal wall, and two upstanding side walls, the receptacle having an open rear face and an open front face:

the top, bottom and sides walls each having an in-turned flange at a front edge thereof at the open front face;

a pivotal rectangular door member mounted inside the receptacle for pivotal movement on hinges along one edge of the door member from a closed position parallel to the open front face to an open position extending outwardly from the open rear face;

the door member defining a vertical front surface which is located adjacent to the open front face and the flanges at the open front surface in the closed position of the door;

a transparent cover panel located at the open front face and generally coextensive therewith so that a front face of the cover panel abuts against the flanges;

and a plurality of spacer members arranged around the front surface of the door member so as to be positioned between the front surface and a rear face of the flanges so as to press the cover panel away from the front surface of the door member into contact with the flanges;

the sheet being placed against the front surface of the door member and held in position by the spacer members so as to be spaced from the cover panel by the spacer members.

Preferably the spacer members are elongate and arranged along a respective one of the flanges.

Preferably the door member is mounted for pivotal movement about the hinges along one side wall of the receptacle.

Preferably the door member can be readily removed from the receptacle by lifting from the hinges.

Preferably there are provided a plurality of discharge holes in the bottom wall to release collected moisture. One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
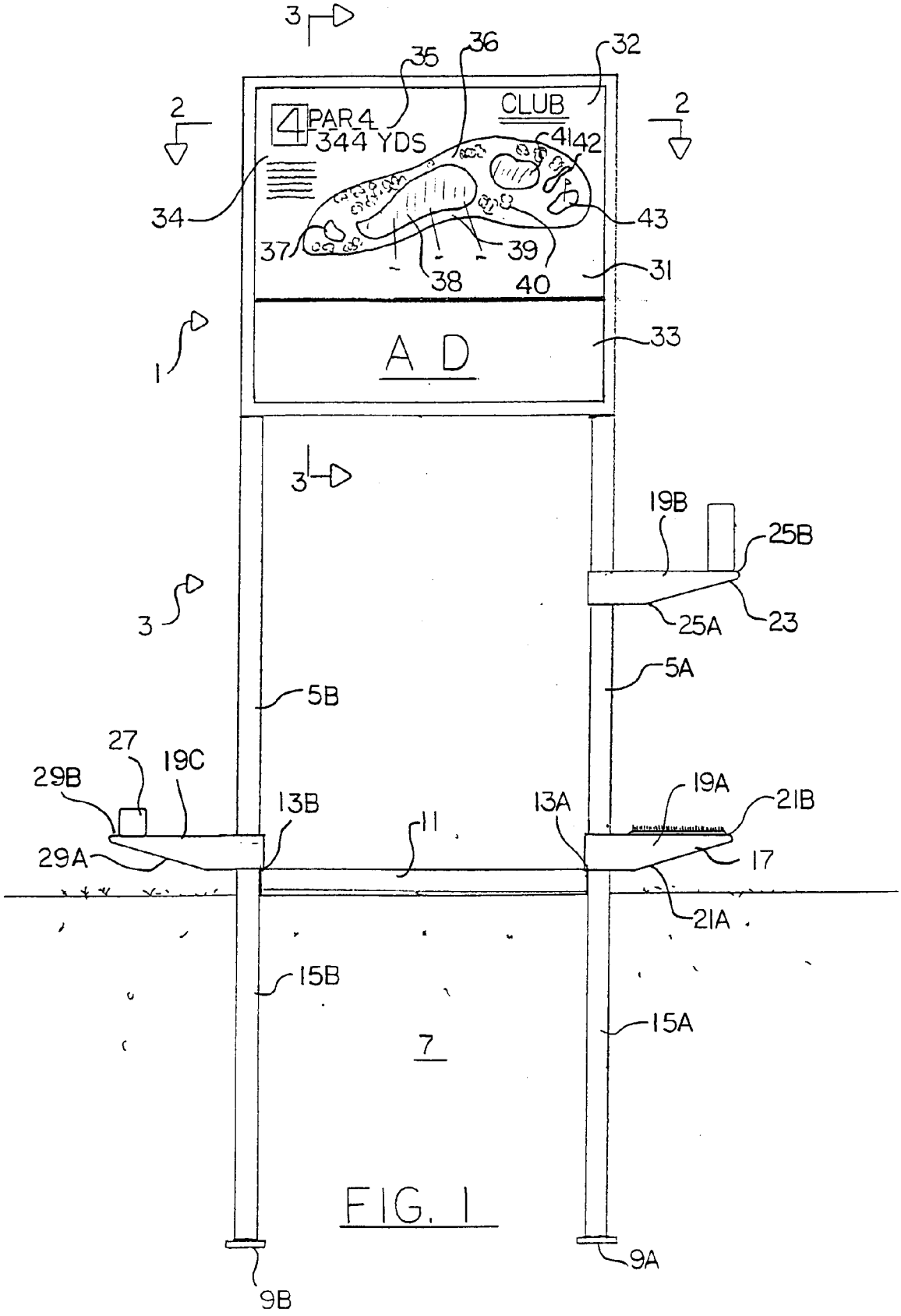
FIG. 1 is front elevational view of the present invention.

A sign for a golf course 1 comprises a vertical support stand 3. The support stand 3 has a first vertical leg 5A and a second vertical leg 5B. The legs 5A and 5B extend vertically in a parallel direction from the ground 7. The legs are elongate rectangular or square tube. At the furthermost bottom end of the first leg 5A is a first anchor 9A. At the furthermost bottom end of the second leg 5B is a second anchor 9B. The legs can be formed from round tubing and can extend through a curve at the upper end to form an arch over the sign.

The anchors 9A and 9B are horizontally positioned and are a flat rectangular plate which is slightly larger in width that the legs 5A and 5B. The anchors are centred and welded to the legs.

A horizontal mid beam 11 is mounted to the legs 5A and 5B to provide support. The horizontal mid beam 11 is an elongated square tube which the first end 13A is welded to the first leg 5A and extends horizontally to the second leg 5B where the second end 13B of the mid beam 11 is welded.

A first underground portion 15A of the first leg 5A starts directly below the mid beam 11. A second underground portion 15B of the second leg 5B starts directly below the mid beam 11. At the end of each underground portion the anchors are welded, as describe above. The underground portion acts to support the sign 1 from swaying forward and backward. The anchors provide support which keeps the sign firmly mounted in the ground.

The mid beam 11 confines the sign from submerging deeper into the ground. The mid beam 11 is positioned parallel with the ground 7 and at a position immediately adjacent the ground. This mid beam acts to hold the structure square and stable and prevents twisting during shipping and installation and particularly if it is required to effect a move of the sign where the beam allows the structure to be easily removed from the ground.

A golf shoe spike cleaner 17 is mounted on a horizontally extending arm 19A. The arm 19A extends horizontally outwards in a direction parallel to the mid beam 11 from the first leg 5A. The first arm 19A is a rectangular tube which the bottom side 21A gradually inclines to a point with the uniform top side 21B of the first arm 19A. The spike cleaner 17 is located on the uniform top side 21B.

A golf ball cleaner 23 is mounted on a second horizontally extending arm 19B. The second arm 19B extends horizontally outwards in a direction parallel to the mid beam 11 from the first leg 5A. The second arm 19B is a rectangular tube which the bottom side 25A gradually inclines to a point with the uniform top side 25B of the second arm 19B. The golf ball cleaner 23 is located on the uniform top side 25B.

A golf club cleaner 27 is mounted on a third horizontally extending arm 19C. The third arm 19C extends horizontally outwards in a direction parallel to the mid beam 11 from the second leg 5B. The third arm 19C is a rectangular tube which the bottom side 29A gradually inclines to a point with the uniform top side 29B of the third arm 19C. The club cleaner 27 is located on the uniform top side 29B. A garbage can may be located on one of the legs in replacement for the spike cleaner.

The accessories mounted on the sign cause the golfer to interact with the sign even if the golfer is familiar with the course. This allows the advertising to be noticed even if the details of the sign are not required by the golfer.

In FIG. 1 the front surface of the printed sheet 31 is shown and this includes an upper area 32 on which is received information concerning the golf course and particularly the hole at which the sign is located. At a lower part of the same sheet is provided an advertising area 33 which is in the form of a photographic or high definition type printed information digitally generated from a computer system preferably using an electrostatic printer. This technique will provide an advertising copy which is satisfactory to even high profile advertisers who require far more than simply a name or logo to be displayed. The sign is laminated. The above technique forms a sign which will not fade.

In the upper part 32 of the sign displaying the golf hole information is included as indicated at 34 information concerning the hole to be played that is the hole number from 1–18. A sign can be provided at the beginning of the course which shows the layout of the whole course. The sign further includes information indicated at 35 relating to the distances from the Tee to the green or more particularly to the flat and other information concerning distances and notes which may be of assistance to the golfer in playing the hole. Finally and most importantly is provided as indicated at 36 a plan of the hole to be played. This includes areas defined on the sheet each of which is a different colour and provides a graphic illustration of the hole. Thus the Tee box area is indicated at 37 and may be formed of a first colour. A main fairway area is indicated at 38 and can be of a first green colour. A rough area is indicated at 39 and is of a second green colour. The treed area is indicated at 40 including possibly individual trees and these are indicated in a dark green colour. A sand trap is indicated at 41 and is of a brown colour. A water hazard is indicated at 42 and is of a blue colour. The green itself is indicated at 43 and is of a pale green colour. Each of these areas is discreet and bounded by a continuous line which separates it from the other areas. Such a map can be generated by computer graphics by plotting from an aerial photograph the areas concerned and by subsequently identifying each closed area with a suitable colour to distinguish it from other areas. The computer graphics techniques by which the map is generated also allows the generation of vignettes, that is graduating colours to show for example changes in depth of water, shades, half tones and quarter tones. All of these techniques allow the manufacture of a map of significantly higher quality and information communication.

Yet further information may be provided on the sheet as required but the above information is the main information desirable to indicate to the golfer.

The sheet can be manufactured relatively inexpensively and can thus be replaced on a seasonal or even shorter basis should the advertising sponsor wish only to take advertising space for a relatively short period of time for example for a weekly or even daily sale.

It has been found that the economics of the above system now enables significant revenue to be generated both for the golf course and for the installer of the signs from advertising revenue. The sign of the present invention has therefore the following advantages:

a) It can be changed at any time for any changes in the hole geography including changes to a number of holes which arise from significant changes to one of the holes, even during a construction phase.

b) It can be changed at any time to accommodate changes in the advertiser information including sales of a temporary nature.

c) It is possible to set out on the sign specific rules relevant to that hole and of course to change the sign should those rules change temporarily. Thus for example the map can show areas which are out of bounds and can also indicate other areas such as linear water hazards which of course have different stroke rules. Should the rules at the hole change temporarily for example due to landscaping, it is of course possible to mark these changes immediately on the sign by generating a new map and associated information.

d) The differences to the green from various points of reference can be included to assist the golfer in determining the distance of his second or approach shot.

e) The distance from the T box to various hazards can be included to enable the golfer to drive to avoid such hazards.

f) The map can be proportionally accurate or to scale to give a much more accurate indication to the golfer as opposed to the conventional permanent signs which merely provide an impression of the geography.

g) The construction of the mounting for the sign is of a type which will last longer than conventional constructions with less maintenance.

h) The mounting of the sign allows the sign to be resistant to water from sprinklers which is an essential element of golf course operation.

i) The ball washer and other accessories cause the golfer to be brought to the sign for again seeing the advertising.

j) The construction allows movement on repositioning of the sign when required.

k) The ability of the sign to contain significant amounts of information allows the golf course to avoid use of the conventional booklets while giving the golfer enough information.

l) The construction of the mounting for the sign avoids tampering and theft.

m) The use of the printed sign allows the golf course to generate an individual look or appearance or logo which can be used to enhance the image of the golf course.

Figure 2:
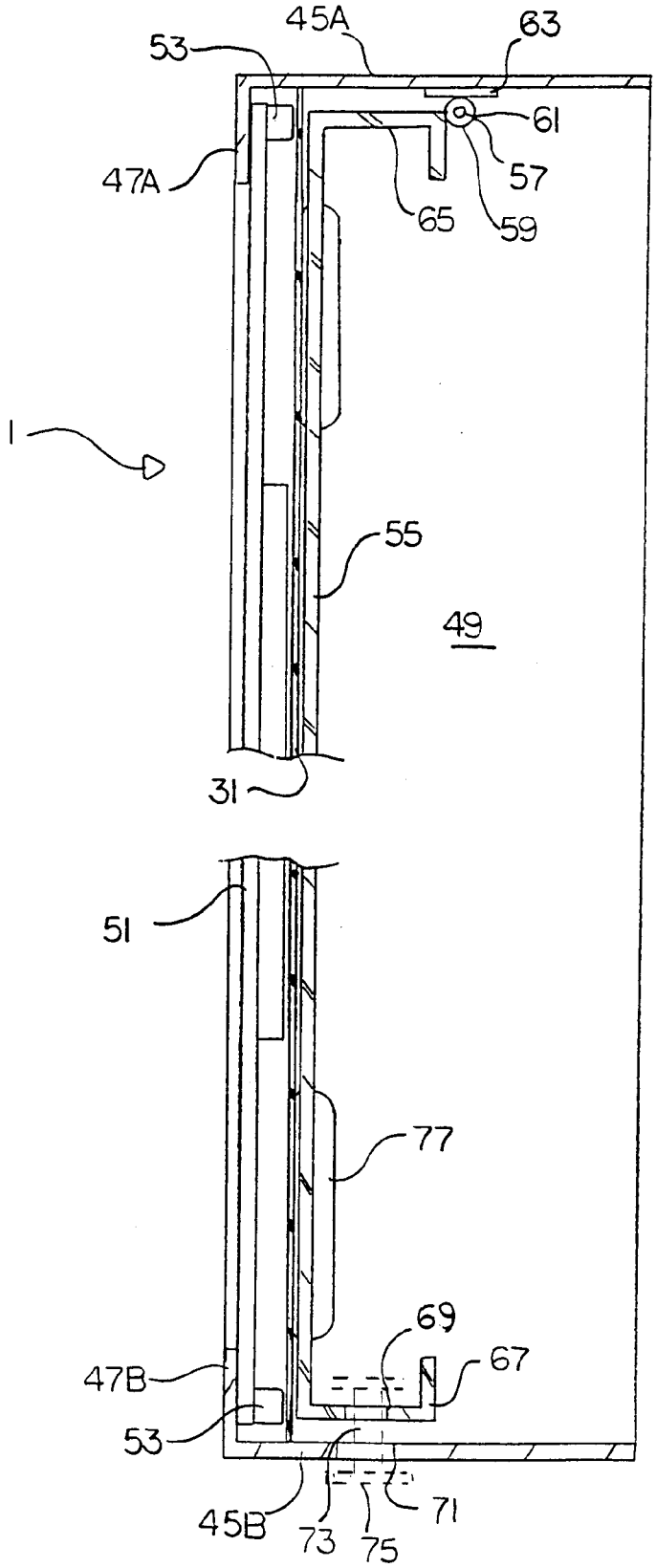
FIG. 2 is a cross section of FIG. 1 along the lines 2—2.
Figure 3:
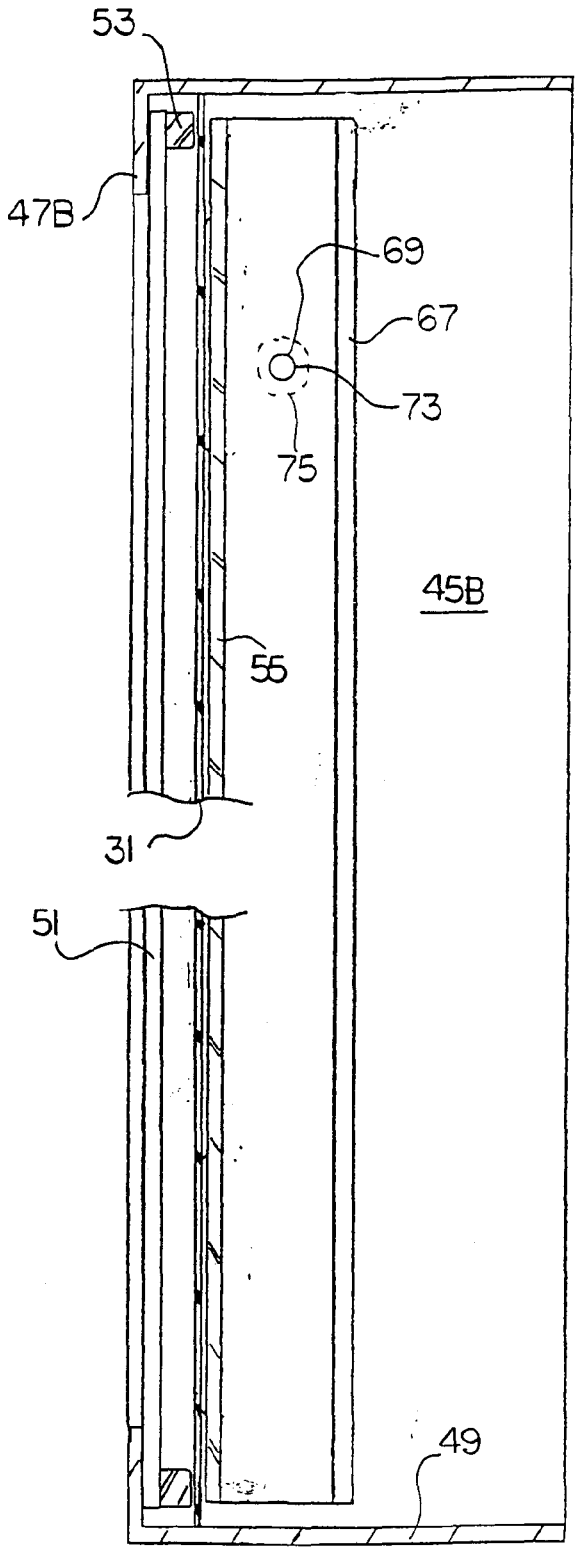
FIG. 3 is a cross section of FIG. 1 along the lines 3—3

FIG. 2 shows a horizontal cross section of the sign 1. The sign 1 is of rectangular shape consisting of a first side wall 45A and a second side wall 45B. A first flange 47A and a second flange 47B are located at the front end of the walls 45A and 45B. A bottom plate 49 fixes the sign 1 to the stand 3 at the top end of the legs 5A and 5B. The bottom plate 49 is centred and welded to the legs.

A flat rectangular clear material 51 which is relatively the same size as the sign is located behind the flanges 47A and 47B which hold the clear material in place. On each corner of the clear material are square pads 53. The pads hold the poster or printed sheet 31 in place. Behind the printed material is a back wall 55 which closes the printed sheet 31 against the pads 53. The back wall has a first end flange 65 which extends rearwardly to a hinge 57.

The hinge 57 consists of a circular tube 59 which is attached to the first end flange. Inserted into the circular tube 59 is a pin 61. The pin 61 extends vertically from a pin ledge 63. The pin ledge 63 is fixed to the first side wall 45A. The hinge allows the back wall to be opened rearwardly in order to change the printed material. The hinge also allows the back wall to be lifted out of the sign.

A second end flange 67 of the back wall has a hole 69 which corresponds with a second hole 71 on the second side wall which allow a latch bolt 73 to be inserted which is tightened by a security nut 75. The security nut 75 can only be loosened with a special type of driver.

A plurality of elongated holes 77 are located on the bottom plate to allow water escape from the sign.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A golf sign for displaying golf hole information on a golf course comprising:

a flexible, replaceable, printed display sheet having thereon a graphic illustration of a golf hole, information concerning distance from the tee of the golf hole to the flat of the golf hole and advertising information relating to a sponsor of the sign;

and a support mount for the display sheet including:

depending legs for mounting the support mount extending vertically from the ground;

a rectangular receptacle mounted on the legs and defining a top horizontal wall, a bottom horizontal wall, and two upstanding side walls, the receptacle having an open rear face and an open front face;

the top, bottom and sides walls each having an in-turned flange at a front edge thereof at the open front face;

a pivotal rectangular door member mounted inside the receptacle for pivotal movement on hinges along one edge of the door member from a closed position parallel to the open front face to an open position extending outwardly from the open rear face;

the door member defining a vertical front surface which is located adjacent to the open front face and the flanges at the open front surface in the closed position of the door;

a transparent cover panel located at the open front face and generally coextensive therewith so that edge portions of a front face of the cover panel abut against respective ones of the in-turned flanges of the top bottom and side walls;

and a plurality of spacer members each arranged at a respective one of the in-turned flanges of the top bottom and side walls;

the sheet being placed against the front surface of the door member in contact therewith;

each spacer member having a front surface in contact with a rear surface of the transparent cover panel and a rear surface in contact with an edge portion of the sheet on the front surface of the door panel so as to hold the transparent cover panel spaced from the sheet and to hold the edge portion of the sheet in contact with the front surface of the door panel.

2. The golf sign according to claim 1 wherein the spacer members are elongate and arranged along a respective one of the flanges.

3. The golf sign according to claim 1 wherein the door member is mounted for pivotal movement about the hinges along one side wall of the receptacle.

4. The golf sign according to claim 1 wherein the door member can be readily removed from the receptacle by lifting from the hinges.

5. The golf sign according to claim 1 wherein there are provided a plurality of discharge holes in the bottom wall to release collected moisture.

6. The golf sign according to claim 1 wherein there is provided a transverse connecting beam interconnecting the legs at a height adjacent the ground.

* * * * *